United States Patent [19]

Sutton

[11] Patent Number: 4,669,949

[45] Date of Patent: Jun. 2, 1987

[54] METHOD FOR POSITIONING FALLEN PALLET LOADS

[75] Inventor: Jerome L. Sutton, Brooklyn Park, Minn.

[73] Assignee: Valley Craft, Inc., Lake City, Minn.

[21] Appl. No.: 693,387

[22] Filed: Jan. 22, 1985

[51] Int. Cl.[4] ..... B66F 11/00

[52] U.S. Cl. ..... 414/786; 414/607

[58] Field of Search ..... 414/281, 607, 608, 785, 414/786, 589, 590

[56] References Cited

U.S. PATENT DOCUMENTS

| | | | |
|---|---|---|---|
| 2,659,506 | 11/1953 | Watkins | 414/785 |
| 2,727,638 | 12/1955 | Sestan | 414/607 X |
| 2,999,608 | 9/1961 | Ganahl | 414/785 X |
| 3,258,146 | 6/1966 | Hamilton | 414/607 |
| 3,477,600 | 11/1969 | Sawyer | 414/785 X |
| 3,606,952 | 9/1971 | Mankey | 414/590 X |
| 3,791,544 | 2/1974 | Moses | 414/785 X |
| 4,252,495 | 2/1981 | Cook | 414/608 |
| 4,272,220 | 6/1981 | Garcia | 414/785 X |
| 4,290,729 | 9/1981 | Cary | 414/785 X |
| 4,447,186 | 5/1984 | Renfro et al. | 414/589 |

*Primary Examiner*—Frank E. Werner
*Assistant Examiner*—David A. Bucci
*Attorney, Agent, or Firm*—Williamson, Bains, Moore & Hansen

[57] ABSTRACT

An apparatus and method are disclosed for repositioning fallen loads. In particular, the device mounts on the fork lift and has a pair of crossbars mounted on the fork lift receiving tubes. The cross members have a height greater than the thickness of the crossbars on the rack system. The fork lift operator engages the bottom surface of the pallet load with the upper surface of the cross members and lifts the pallet load until it is clear of the crossbars whereupon the load is repositioned properly.

1 Claim, 8 Drawing Figures

METHOD FOR POSITIONING FALLEN PALLET LOADS

BACKGROUND OF THE INVENTION

The problem of fallen or mispositioned loads has been a problem with warehouses for many years. Such fallen loads can result from several causes. First, the pallet chosen for placement on a rack system may be such that the length of the pallet is less than the distance between the crossbars of the rack. In such a situation, no matter how careful the fork lift operator, the load will fall between the crossbars. In another situation, a careless operator may not set the pallet load on the crossbars properly and the load then falls at least partially between the crossbars. Lastly, a load may originally be properly placed on the crossbars but in placement of an adjacent load, the load is bumped and falls between the crossbars. To date, there has been no satisfactory solution to this problem. The problem has been solved by workers physically climbing up onto the rack and physically dismantling the load and the pallet by hand. It can be appreciated, of course, that this may involve an appreciable amount of time as well as the possible danger inherent in working at the heights of the higher portions of the rack. Alternatively, a solution has been literally to stick the forks of the fork lift truck into the side of the load in order to lift the load out between the crossbars and remove it. This, of course, causes a substantial amount of harm to the load itself.

It is therefore an object of this invention to provide a method and apparatus for repositioning fallen loads and which may be easily and quickly operated and performed by a fork lift operator. It is further an object of this invention to provide a device which is easily and inexpensively manufactured and which will be suitable for performing as described.

SUMMARY OF THE INVENTION

In warehousing situations, pallets having loads strapped thereon are placed on racks which are often many levels high. The racks have upright members and crossbars, the pallet loads being placed on the crossbars. The instant invention is comprised of a pair of fork lift, fork receiving tubes which have a pair of cross members attached thereto. The cross members are parallel to each other and spaced apart as well as being perpendicular to the fork receiving tubes. The thickness or height of the cross members above the fork receiving tubes is greater than the thickness of the crossbars in the rack system. The length of the cross members is slightly longer than the width of the pallet load, and each cross member has a lip at either end thereof which extends above the top of the cross member to help restrain the pallet therebetween. A piece of angle iron may be attached to the top of each cross member to provide a means of gripping or digging into the bottom surface of the pallet in order to prevent sliding. Of course, other methods of gripping may be utilized if desired. Also, if desired, a locking mechanism may be provided to secure the fork receiving tubes to the fork lift forks.

In practice, the fork lift operator inserts forks of the fork lift into the fork receiving tubes. The apparatus is then lifted to a height slightly less than the crossbars beneath the fallen load and the fork lift driven forward until the cross members are directly beneath the bottom surface of the fallen load intermediate the crossbars. The forks are then raised until the bottom surface of the fallen load is clear and above the crossbars. The load is then moved forward or back until it is directly over both of the pair of crossbars at which point it is lowered into position. It should be noted that all of this may be accomplished without the fork lift operator ever having to leave the lift. In the event the space between the fallen load and the load immediately beneath is insufficient for insertion of the device, the load beneath may be easily removed in the normal manner to provide sufficient working space.

An alternate embodiment of the instant invention provides a device which may be adjusted to suit varying size pallets as well as varied size rack systems. A pair of sleeves slides on the fork receiving tubes and in turn receive sliding, two-piece cross members, which may be slid to vary the width of pallet accepted. End plates located on the end of the cross members may be adjusted to vary the effective height of the cross member relative to the forks of the fork lift.

These and other objects and advantages of the invention will appear more fully from the following description with the accompanying drawings wherein like reference characters refer to the same or similar parts throughout the several views.

DESCRIPTION OF THE PREFERRED EMBODIMENT

Figure 1:
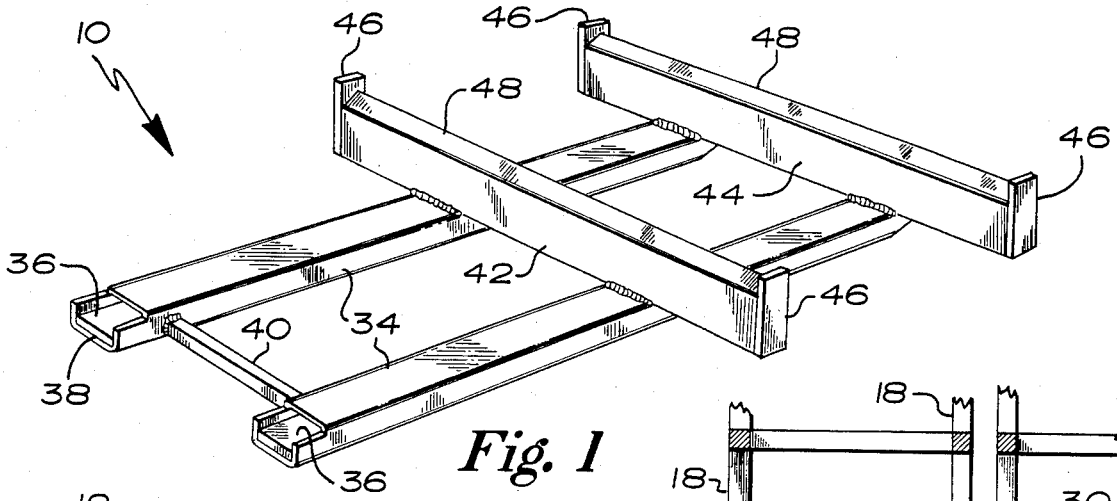
FIG. 1 is a perspective view of the apparatus of the instant invention.

The instant invention, generally designated 10, is shown by itself in FIG. 1. The instant invention is designed generally for use with a fork lift 12 having forks 14 mounted on the front thereof. Typically, forks 14 are vertically movable relative to fork lift 12. For best operation of the invention 10, it is preferable that fork lift 12 have side-shift, although the side-shift feature is not required.

Figure 2:
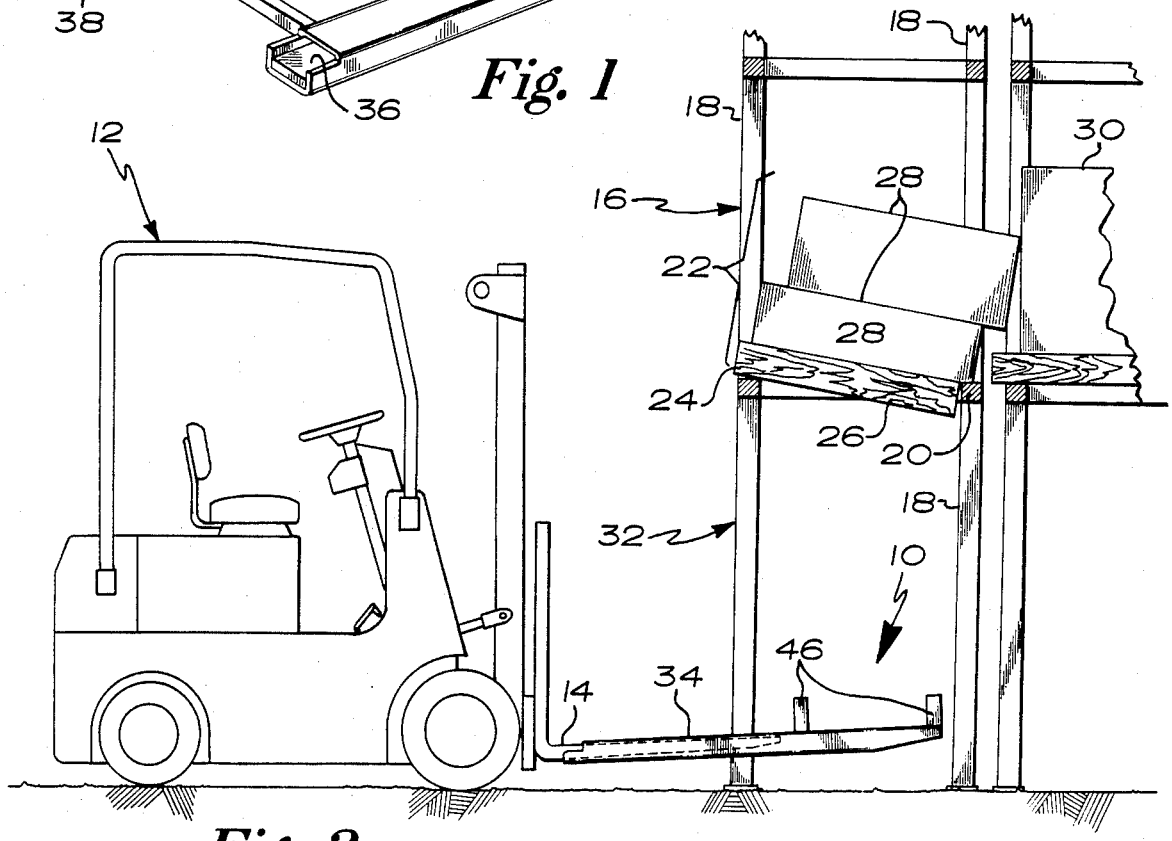
FIG. 2 is a side plan view showing the apparatus approaching a fallen load.

The lifter of the instant invention 10 is designed for use with a rack system 16 which may be found in a warehouse and which consists of uprights 18 connected together by crossbars 20. In general, pallet loads 22 are designed to rest on an adjacent pair of crossbars as shown in the drawings. Pallet load 22 consists of a pallet 24 having a bottom surface 26. A load 28 may be strapped, shrink wrapped, or otherwise fastened to pallet 24, thus forming a unitized pallet load 22. Typically, a pair of racks 16 would be adjacent to one another as shown in FIG. 2, each being accessible from an aisle such as shown by the positioning of fork lift 12. An adjacent pallet load 30 may be the cause of the fallen load if the adjacent load 30 were to contact the load 22 and push it into the position shown in FIG. 2.

The fork lift 12 accesses pallet load 22 from the front 32 of rack 16.

Turning particularly to FIG. 1, invention 10 is comprised of a pair of fork receiving tubes 34 which are sized and shaped to closely and telescopically accommodate a pair of forks 14. Tubes 34 have fork receiving openings 36 in the end thereof. A retainer lip 38 extends partially upwardly at the end of the opening to assist in retaining forks 14 in tubes 34. A crossbar 40 may be added if desired between tubes 34 for additional strength and stability.

First and second cross members 42 and 44 are attached by welding or other conventional means to fork receiving tubes 34 perpendicular thereto and parallel to each other as shown. Cross members 42 and 44 are spaced apart a distance slightly less than the spacing between crossbars 20 as shown in FIG. 4. Cross members 42 and 44 extend above fork tubes 34 a distance somewhat higher than the thickness of crossbars 20 as can also be seen such that when the top surface of fork tubes 34 contacts the underside of crossbars 20, the bottom surface 26 of pallet 24 will be clear and above the upper surface of crossbars 20. This is shown in detail in FIG. 3.

Cross members 42 and 44 have a length that is slightly longer than the width of pallet 24 thereby enabling end lips 46 located on either end of cross members 42 and 44 to restrain and position pallet load 22 therebetween. An angle iron 48 may be attached by welding or other conventional means to the top surface of cross members 42 and 44 to provide a gripping effect on the bottom surface 46 of pallet 24. It can be appreciated, of course, that various other means of enabling the invention to be non-slipingly engaged with load 22 may be provided. Such other means could include serrated edges or perforated metal.

Figure 6:
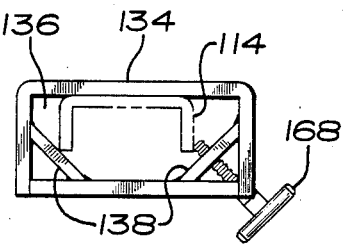
FIG. 6 is a sectional view taken along line 6—6 of FIG. 5.
Figure 7:
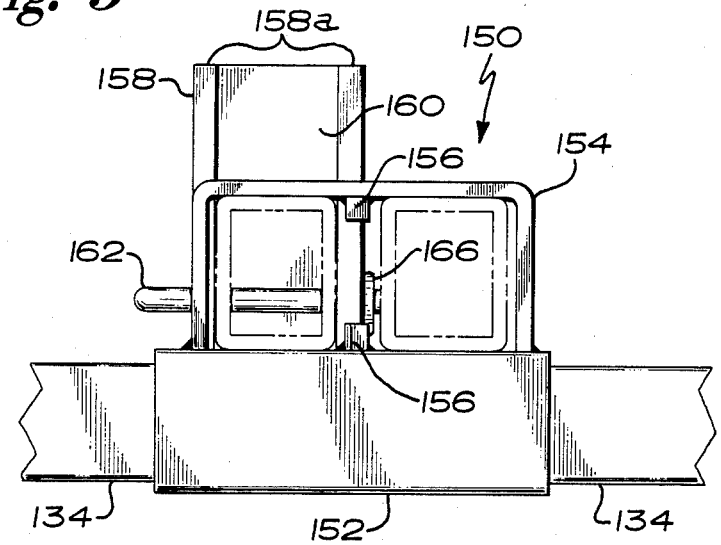
FIG. 7 is a sectional view taken along line 7—7 of FIG. 5.
Figure 8:
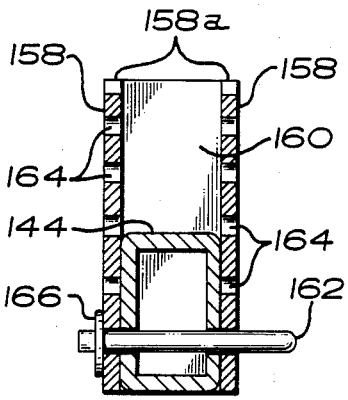
FIG. 8 is a sectional view taken along line 8—8 of FIG. 5.

The embodiment of FIGS. 5 through 8 provides the instant invention with the ability to accommodate varying size loads and rack systems. In particular, the alternate embodiment 110 receives the forks 114 of a fork lift truck and fork receiving tubes 134. An opening 136 is located in the end of fork receiving tubes 134 for receiving the fork 114 as shown in FIG. 6. Angle plates 138 are located in fork receiving tube 134 and help locate the fork 114 therein. A set screw 168 may be added if desired to assist in locking the device 110 on forks 114.

Crossbars 142 and 144 are slidably mounted on fork receiving tubes 134 and have fork assemblies 146 located at the ends thereof. Crossbars 142 and 144 are slidably attached to fork receiving tubes 134 by slide assemblies 150 which are shown in detail in FIG. 7. Each slide assembly 150 is comprised of a general rectangular tube 152 which is sized to slide over fork receiving tube 134. Mounted by welding or other known techniques to the top of tube 152 is a channel member 154 which slidably receives crossbars 142 and 144 at right angles to fork receiving tube 134. If desired, divider rails 156 may be utilized to separate and locate crossbars 142 and 144 in channel member 154.

Each fork assembly 146 consists of a pair of risers 158 having a top edge containing serated gripping teeth 158*a*. The risers 158 are connected by a side plate 160 to form the U-shaped channel of the fork assembly 146. Each riser 158 has two columns of holes 164 located near the edges of the risers 158 which overlap the columns of holes 164 on the adjacent riser 158 . A handle 162, bent to a U-shaped form with each end of the handle 162 positioned to extend through the holes 164 in the risers 158 and the aligned holes 165 in the crossbars 142 144 is fastened in place using cotter pins 166. The handle 162 is used to set the height of the top edgge 158*a* of each riser 158 above the crossbars 142, 144, as well as being convenient to laterally adjust the position of the crossbars 142, 144 relative to the fork receiving tubes 134.

Figure 3:
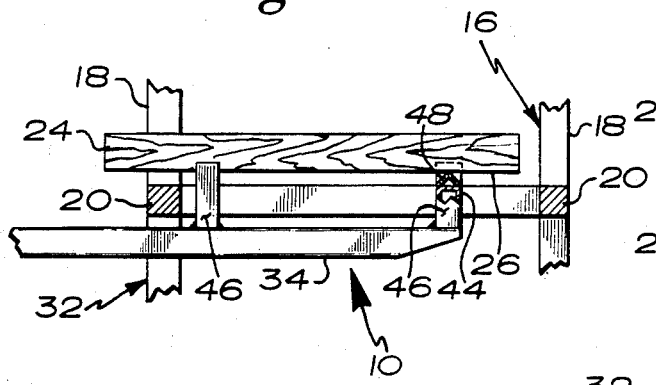
FIG. 3 is a similar view to FIG. 2 showing the load lifted partially in place.
Figure 4:
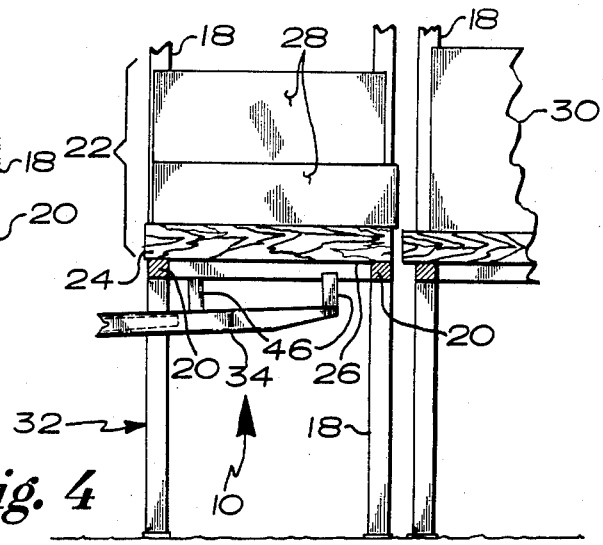
FIG. 4 is a similar side plan view showing the load properly positioned.
Figure 5:
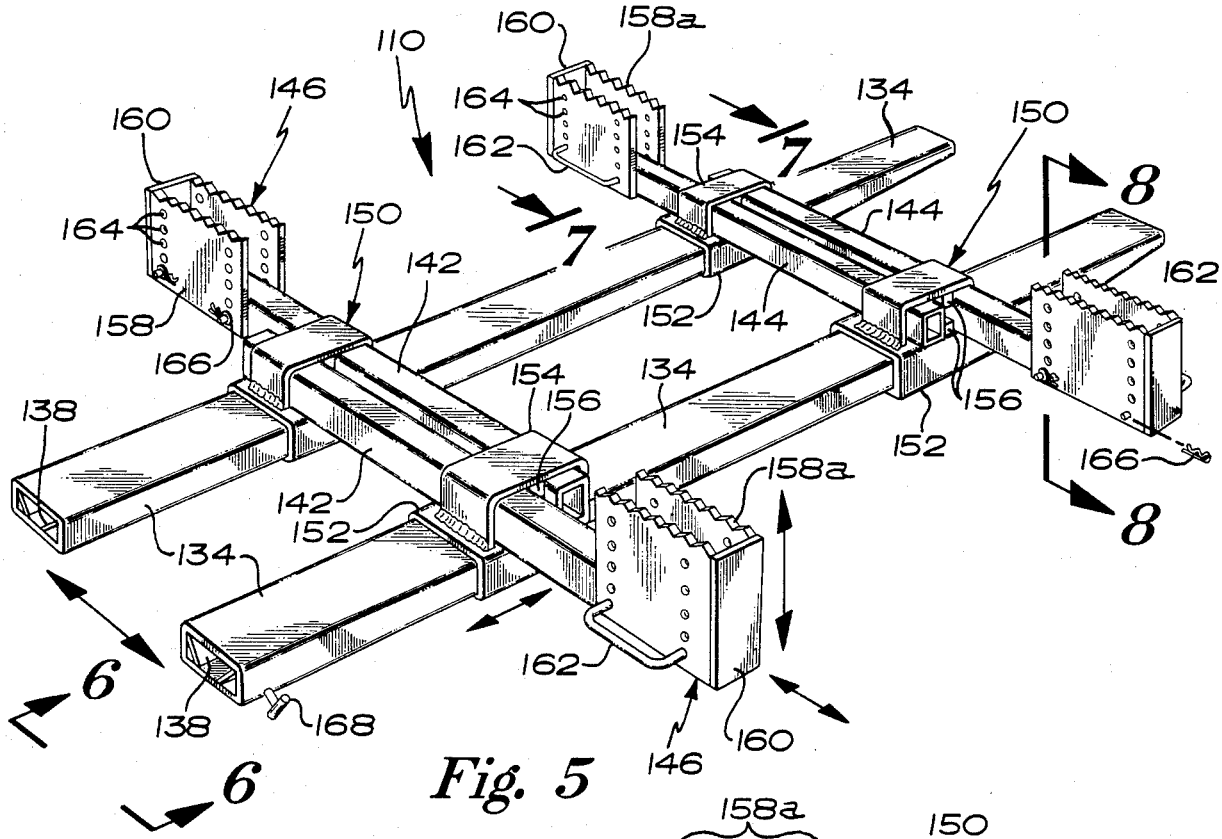
FIG. 5 is a perspective view showing an alternate embodiment of the instant invention.

The operation of the method and apparatus of the instant invention is shown in FIGS. 2 through 4. Initially, the operator of fork lift 12 slides the forks 14 into fork receiving tube 34. The driver then approaches the rack system 16 as shown in FIG. 2 and positions lift device 10 directly beneath pallet load 22 between crossbars 20. The forks 14 in device 10 are then raised to the position shown in FIG. 3 wherein the bottom surface 26 of pallet 24 is lifted above crossbars 20. At this point, the operator moves the fork lift 12 either forward or backward (to the left or right in FIG. 2) until the pallet load 22 is over both crossbars 20. The forks 14 are then lowered as shown in FIG. 4 thereby leaving the pallet load 22 properly located on the crossbars 20 of rack system 16. While for simplicity sake in FIGS. 2 through 4 only two pallet loads 22 and 30 are shown, it can be appreciated that even if a further pallet or pallets is located beneath pallet load 22, only a relatively small amount of space between the top load and the bottom of crossbars 20 is required for operation of the instant method and apparatus. In the event such space is not available, the top pallet load beneath crossbars 20 may need merely be removed to the floor to provide the required space. All this may be accomplished without the operator leaving the fork lift 12 and the time saving involved over the previous manual method is quite substantial.

While the preferred embodiments of the present invention have been described, it should be understood that various changes, adaptions and modifications may be made therein without departing from the spirit of the invention and the scope of the appended claims.

What is claimed is:

1. A method for a fork lift having forks to position fallen pallet loads on a rack having uprights connected by crossbars, said crossbars having a thickness and a predetermined spacing, said method comprising the steps of:

Engaging the lower surface of a fallen pallet load between and from beneath a pair of said crossbars with upwardly extending members which project upwardly above the top of the forklift forks lifting said pallet load until said upwardly extending members and all of said load is above said crossbar pair;

moving said load horizontally perpendicular to said crossbars until said lower surface is over said crossbar pair; and lowering said load onto said crossbar pair.

* * * * *